US007063605B2

(12) United States Patent
Spiegel

(10) Patent No.: US 7,063,605 B2
(45) **Date of Patent: *Jun. 20, 2006**

(54) RETAINING RING FOR WAFER CARRIERS

(75) Inventor: Larry A. Spiegel, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/084,475

(22) Filed: Mar. 18, 2005

(65) Prior Publication Data

US 2005/0164617 A1 Jul. 28, 2005

Related U.S. Application Data

(63) Continuation of application No. 10/680,995, filed on Oct. 7, 2003, now Pat. No. 6,869,348.

(51) Int. Cl.
*B24B 1/00* (2006.01)

(52) U.S. Cl. ..... 451/286; 451/398; 451/297; 451/287

(58) Field of Classification Search ..... 451/398, 451/285–289, 397, 41; 438/692–693
See application file for complete search history.

(56) References Cited

U.S. PATENT DOCUMENTS

| | | | | |
|---|---|---|---|---|
| 5,310,455 | A | 5/1994 | Pasch et al. | |
| 5,584,751 | A | 12/1996 | Kobayashi et al. | |
| 5,795,215 | A | 8/1998 | Guthrie et al. | |
| 6,136,710 | A | 10/2000 | Quek et al. | |
| 6,206,758 | B1 | 3/2001 | Lai et al. | |
| 6,231,428 | B1 | 5/2001 | Maloney et al. | |
| 6,277,008 | B1 | 8/2001 | Masuta et al. | |
| 6,354,927 | B1 | 3/2002 | Natalico | |
| 6,390,904 | B1 | 5/2002 | Gleason et al. | |
| 6,869,348 | B1 * | 3/2005 | Spiegel | 451/398 |

* cited by examiner

*Primary Examiner*—George Nguyen
(74) *Attorney, Agent, or Firm*—Marc J. Frechette, Esq.; K. David Crockett, Esq.; Crockett & Crockett

(57) ABSTRACT

A long-lasting retaining ring for wafer carriers used in chemical mechanical planarization. A groove is disposed around the retaining ring, with the groove opening facing the mounting plate. A ridge is disposed in the groove. A bladder is disposed in the groove and is pressed between the ridge and the mounting plate. Pressure in the bladder can be maintained or adjusted to deform the bladder and thereby force the retaining ring onto the polishing pad as the retaining ring is worn. Prior to adding pressure to the bladder, the ridge forces the bladder to very closely conform to the dimensions of the groove. Thus, during use, bladder deformation is not wasted on conforming the bladder to the groove shape, but instead can be used to force the retaining ring further in the direction of the pad. The ridge thereby increases the distance the retaining ring can move towards the pad.

6 Claims, 3 Drawing Sheets

21
10
1
20
5
5
4
22
2
3
3
2
8
8
9
9
7
6

RETAINING RING FOR WAFER CARRIERS

This application is a continuation of U.S. application Ser. No. 10/680,995 filed Oct. 7, 2003, now U.S. Pat. No. 6,869,348.

FIELD OF THE INVENTIONS

The inventions described below relate the field of wafer carriers and particularly to wafer carriers used during optics polishing, prime wafer polishing and chemical mechanical planarization.

BACKGROUND OF THE INVENTIONS

Integrated circuits, including computer chips, are manufactured by building up layers of circuits on the front side of silicon or other semiconductor wafers. An extremely high degree of wafer flatness and layer flatness is required during the manufacturing process. Chemical mechanical planarization (CMP) is a process used during device manufacturing to polish wafers and the layers built-up on wafers to the necessary degree of flatness.

Chemical mechanical planarization is a process involving the polishing of a wafer with a polishing pad combined with the chemical and physical action of a slurry pumped onto the pad. The wafer is held by a wafer carrier, with the backside of the wafer facing the wafer carrier and the front side (device side) of the wafer facing a polishing pad. A retaining ring extends downwardly from the outer portion of the wafer carrier and surrounds the edge of the wafer during polishing. The retaining ring thus prevents the wafer from being pulled or pushed away from the carrier during polishing. The retaining ring also affects how the pad contacts the edge of the wafer. In particular, the bottom surface of the retaining ring is kept even with the front surface of the wafer, thereby ensuring that the polishing pad evenly wears the wafer.

A polishing pad used to polish the wafer is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing.

By using this process a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated in subsequent polishing cycles. When all layers have been added and all cycles have been completed, a plurality of integrated circuit chips are built-up on the front side of the wafer.

A problem encountered during the polishing cycles is that the bottom surface of the retaining ring is incidentally worn down by the pad and eventually must be replaced. Depending on the exact process used, a given retaining ring may last between several dozen polishing cycles to several thousand polishing cycles. Eventually, however, the bottom surface of the retaining ring can no longer remain flush with the front side of the wafer, and thus becomes unusable. Replacing the retaining ring is expensive, time consuming and disruptive to the manufacturing process. Thus, a device is needed to increase the operational life of retaining rings and thereby increase the efficiency of integrated chip production.

SUMMARY

The methods and devices provided below provide for a wafer carrier having a long-lasting retaining ring. A rectangular channel or groove is disposed in the retaining ring. A triangular ridge integrally formed with the retaining ring extends from the bottom of the groove towards the carrier mounting plate. A rectangular inflatable bladder is provided within the groove.

Just prior to use, the inflatable bladder is pinched between the ridge and a carrier mounting plate, causing the inflatable bladder to very closely conform to the dimensions of the groove. During use, the pressure in the bladder is maintained or increased as the bottom surface of the retaining ring is worn away. The pressure in the bladder urges the bladder walls to expand, thereby applying a force against the groove walls and floor, and against the mounting plate. Since the groove walls and the mounting plate are rigid and radially fixed with respect to the axis of the carrier, the mounting plate is axially fixed with respect to the wafer carrier, and since the retaining ring is slidably attached to the mounting plate, the pressure urges the retaining ring towards the pad. Thus, the bottom surface of the retaining ring remains at a pre-determined height with respect to the front side of the wafer even as the bottom surface of the retaining ring is worn away. Since more of the retaining ring may be worn away before the retaining ring needs to be replaced, the retaining ring need be replaced less often.

Without the ridge, the bladder would not conform as closely to the dimensions of the groove before use. Pressure that would have been used to cause the bladder to force the retaining ring to slide further towards the polishing pad is instead wasted on deforming the bladder to the shape of the channel. (The bladder's ability to expand is limited, as is the pressure that can be applied to the bladder.) Thus, the ridge allows the retaining ring to slide further towards the polishing pad during use, thereby increases the life of the retaining ring.

DETAILED DESCRIPTION OF THE INVENTIONS

Figure 1:
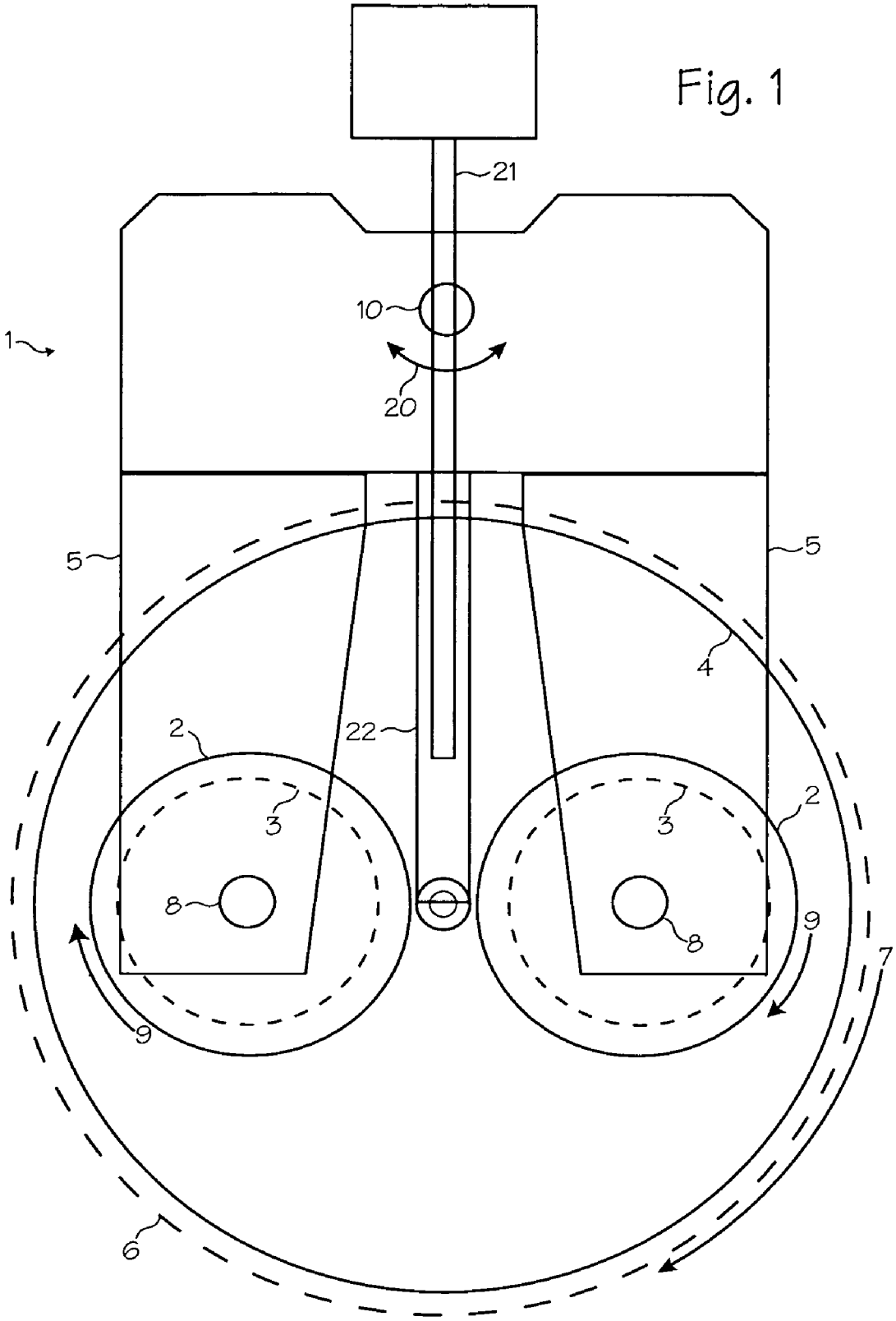
FIG. 1 shows a system for performing chemical mechanical planarization.

FIG. 1 shows a system 1 for performing chemical mechanical planarization. One or more polishing heads or wafer carriers 2 hold wafers 3 (shown in phantom to indicate their position underneath the wafer carrier) suspended over a polishing pad 4. A wafer carrier thus has a means for securing and holding a wafer. The wafer carriers are suspended from translation arms 5. The polishing pad is disposed on a platen 6, which spins in the direction of arrows 7. The wafer carriers 2 rotate about their respective spindles 8 in the direction of arrows 9 (though the wafer carriers may also rotate in the opposite direction). The wafer carriers are also translated back and forth over the surface of the polishing pad by the translating spindle 10, which moves as indicated by arrows 20. The slurry used in the polishing process is injected onto the surface of the polishing pad through slurry injection tube 21, which is disposed on or through a suspension arm 22. (Other chemical mechanical planarization systems may use only one wafer carrier that holds one wafer, or may use several wafer carriers that hold several wafers. Other systems may also use separate translation arms to hold each carrier.)

Figure 2:
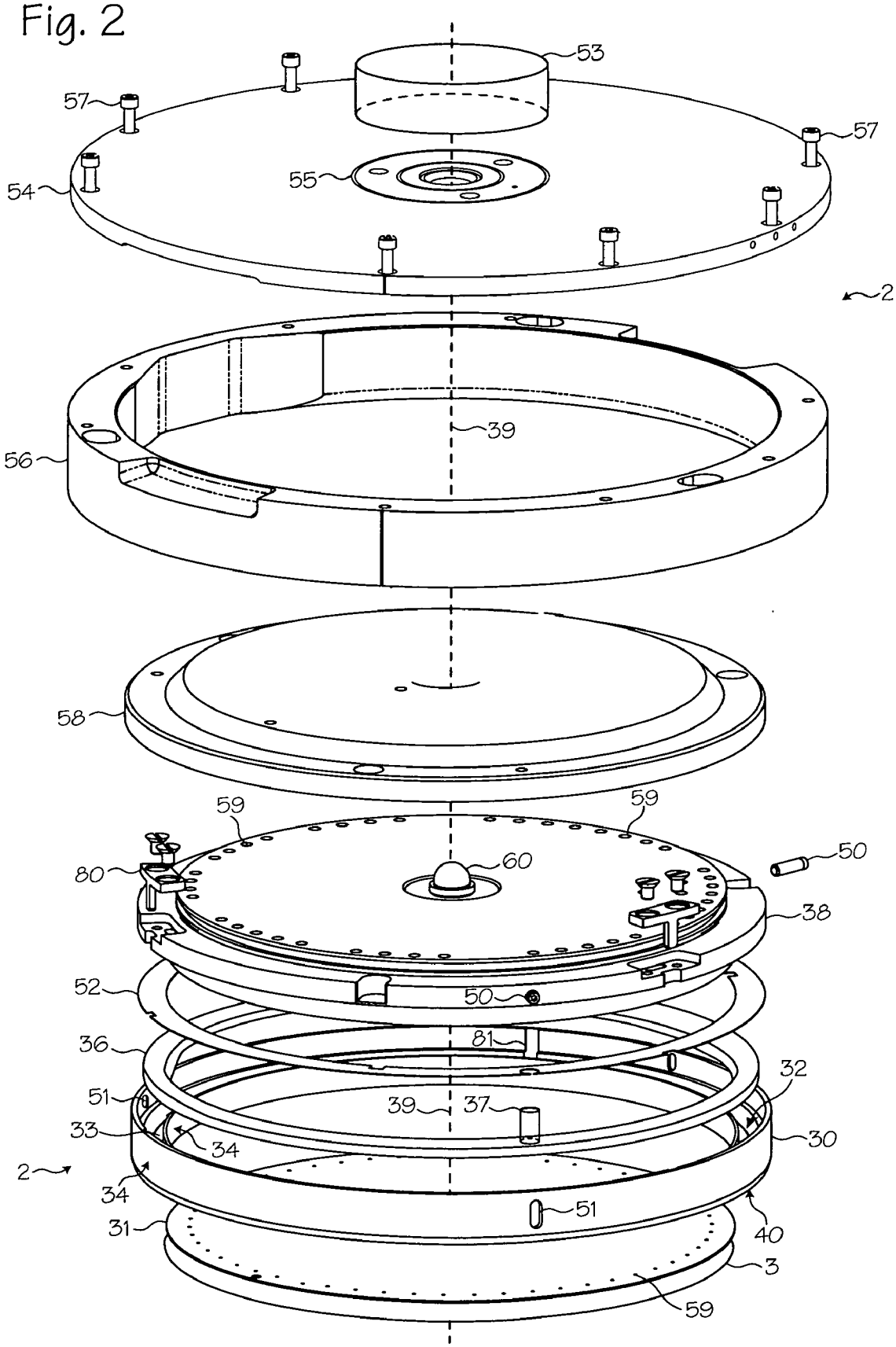
FIG. 2 shows an exploded view of a wafer carrier operable with the system of FIG. 1.

FIG. 2 shows an exploded view of a wafer carrier 2 operable with the system of FIG. 1. A retaining ring 30 surrounds the edge of the wafer during polishing and prevents the wafer from moving radially with respect to the axis of the wafer carrier. (Without the retaining ring, shear forces may push the wafer away from the carrier during polishing.) An insert 31 supports the backside of a wafer 3 when the wafer carrier pushes the wafer onto a polishing pad during polishing.

The retaining ring 30 is provided with a rectangular channel or groove 32 disposed in the upper surface of the retaining ring. The groove is bounded by a floor 33 and inner and outer sidewalls 34. A ridge 35, shown in FIG. 3, extends upwardly (in the direction of the mounting plate) from the floor of the groove. An inflatable bladder 36, in the form of a resilient, compliant tubular hoop with a rectangular radial cross section is disposed within the groove when the wafer carrier is assembled. The tube is an inflatable bladder and is available from a variety of vendors. The ridge 35 is provided to deform the inflatable bladder 36 before use so that no additional pressure is needed to cause the bladder to very closely conform to the shape of the groove. (The ridge also increases the stiffness of the retaining ring). Thus, the bladder applies pressure more evenly to the retaining ring. Accordingly, the retaining ring applies pressure more evenly to the pad. Since pressure is more evenly applied to the pad, the wafer, and particularly the edge of the wafer, is polished more evenly.

The inflatable bladder 36 is provided with a fluid supply tube 37 that places the inflatable bladder in fluid communication with a supply of fluid, such as air or water. The supply tube is operably connected to a means for regulating the pressure in the inflatable bladder, such as a pressure regulator and source of pressurized fluid, that is capable of maintaining or adjusting the pressure in the inflatable bladder. A control system may be provided to control the pressure regulator in response to operator input or to a program. During polishing, the pressure in the inflatable bladder is maintained or adjusted to control the vertical position (along axis 39) of the retaining ring. Thus, the retaining ring is provided with a means for urging the retaining ring towards the polishing pad. (Other means may be provided, such as springs or screws.)

In use, when the pressure in the inflatable bladder is increased, the inflatable bladder tends to expand and apply force against the walls of the groove, the ridge and floor of the groove and against the mounting plate. The mounting plate 38 and the walls are rigid and radially fixed with respect to the axis 39 of the carrier, so they do not move radially with respect to the wafer carrier during polishing. The mounting plate is also axially fixed with respect to the carrier (the mounting plate does not move up and down with respect to the carrier.) Since the retaining ring is attached to the mounting plate such that the retaining ring is slidable a distance along the axis of the wafer carrier, the retaining ring is pushed towards the pad as the bladder expands. As the bottom surface of the retaining ring is worn away, pressure in the inflatable bladder is maintained or gradually increased so that the bottom surface 40 of the retaining ring continues to remain at the desired height relative to the wafer 3. The desired height may be above, below or flush with the front side of the wafer.

The retaining ring may be made slidable along axis 39 by any suitable means. In the carrier shown in the figures, the retaining ring 30 is attached to the mounting plate 38 via screws 50 that are secured to the mounting plate. The screws extend radially into slots 51 disposed in the retaining ring and closely fit within the slots. Initially, the screws are disposed near the bottom portion of the slots. As the inflatable bladder expands, the retaining ring is forced downwardly towards the polishing pad and the slots slide over the screws. The total distance the retaining ring can be moved is limited by the size of the slots, the size of the screws and the maximum deformation of the bladder as the bladder expands.

Optionally, one or more shims 52 may be disposed between the mounting plate 38 and the top surface of the edges of the retaining ring groove 32. The shim increases the distance between the mounting plate and the retaining ring, thereby increasing the distance the retaining ring extends downwardly towards the pad. Thus, the shim or shims help to establish the initial distance between the bottom surface of the retaining ring and the bottom surface of the insert. If a shim extends into the groove, then the thickness of the shim may affect the pressure within the inflatable bladder, and hence the amount of force the retaining ring will apply to the polishing pad. (In some of our wafer carriers, shim 52 is used as part of the carrier assembly and does not affect the performance of the retaining ring.)

In addition to the retaining ring 30, insert 31 and mounting plate 38 (also referred to as a wafer mounting plate), other portions of the wafer carrier are shown to illustrate the relationship of the retaining ring to the rest of the wafer carrier. The entire wafer carrier is suspended by and rotated by a spindle 53 attached to a top plate 54 at socket 55. The top plate is attached to the carrier housing 56 via screws 57. The carrier housing seals the carrier from slurry and other fluids, and also serves as a means for transferring torque from the spindle to the mounting plate. A manifold plate 58 is disposed between the top plate and the mounting plate. The manifold plate, along with various tubes, serves as means for controlling the flow of fluid through the carrier. The mounting plate is attached to the manifold plate and to the retaining ring. (The mounting plate is also provided with a plurality of holes 59 to transfer a vacuum to the insert 31, which is also provided with a plurality of holes 59. The vacuum holds the wafer to the insert). A pivot mechanism 60 is attached to the mounting plate and allows the wafer carrier to pivot during polishing. In use, an insert and a wafer are mounted to the bottom of the mounting plate and the bottom surface 40 of the retaining ring remains at a pre-determined height with respect to the front side of the wafer during polishing. The pre-determined height is determined empirically by analyzing how the wafer is polished across the surface of the wafer and adjusting the height accordingly, though the height may be in the range of about 0 inches to about 5 thousandths of an inch for most applications. In some applications the bottom surface of the retaining ring could be above (with respect to the pad) the surface of the front side of the wafer by about the same amount.

Figure 3:
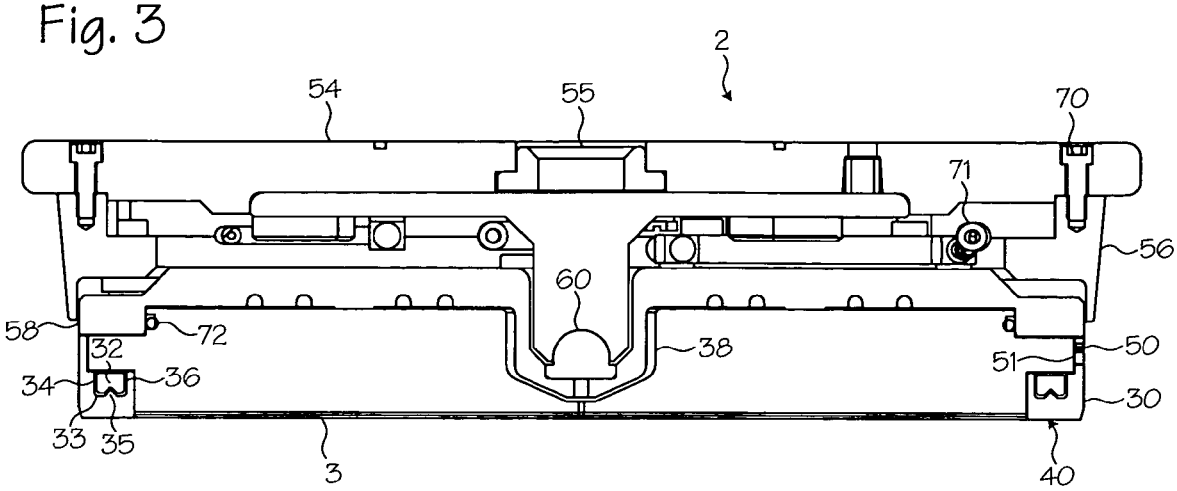
FIG. 3 shows a cross section of an assembled wafer carrier operable with the system of FIG. 1.
Figure 4:
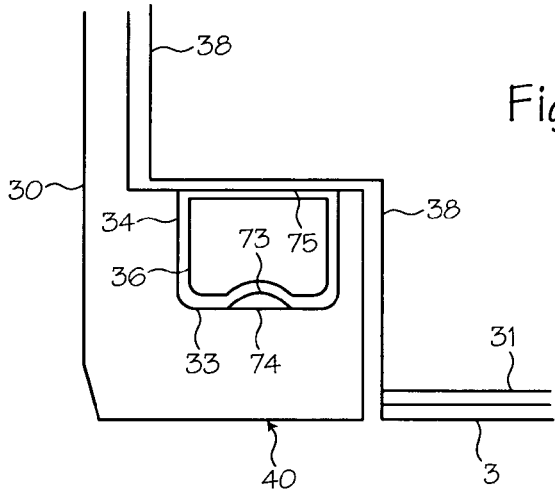
FIG. 4 shows a blown-up cross section of the retaining ring.

FIGS. 3 and 4 show cross sections of an assembled wafer carrier 2 operable with the system of FIG. 1. Various parts of the wafer carrier are shown in relation to each other, including the top plate 54, spindle socket 55, carrier housing 56, manifold plate 58, mounting plate 38, pivot mechanism 60, retaining ring 30, inflatable bladder 36 and part of the slot and screw arrangement (items 50 and 51) that slidably attaches the retaining ring to the mounting plate. Some of the fasteners 70, tubes 71 and O-rings 72 are also shown with the carrier to show the context of the inventions described herein. Components 70, 71 and 72 are used in one of our wafer carrier models to perform various functions before, during or after polishing.

As shown in FIG. 3, the retaining ring 30 is provided with a triangular ridge 35 integrally formed with the floor 33 of the rectangular groove 32. The ridge extends around the retaining ring such that the ridge forms a ring having a triangular cross section. The ridge also extends upwardly towards the mounting plate a distance sufficient to deform the inflatable bladder to the point where the walls of the bladder very closely conform to the shape of the groove when the inflatable seal is pressurized to a nominal ambient pressure, typically about 5 PSI to about 60 PSI. Thus, the inflatable bladder is pre-deformed to conform to the shape of the retaining ring before additional fluid is provided to the inflatable bladder. (Since the ridge causes the inflatable bladder to very closely conform to the shape of the retaining ring, the engineering tolerances required for the inflatable bladder and the retaining ring are thereby greatly reduced.)

The ridge 35 is disposed within the groove so that the ridge is symmetrically disposed relative to the bladder walls; that is, the walls of the bladder abutting the walls of the groove. Thus, the portions of the bladder to either side of the ridge apply equal pressure to the ridge and the floor of the groove. For most of our retaining rings, the ridge preferably is also disposed symmetrically between the groove walls 34 so that the distance between one groove wall and a corresponding wall of the ridge is equal to the distance between the other groove wall and the other wall of the ridge. The bladder is pinched, or partially collapsed, between the mounting plate 38 and the ridge 35. Since the groove walls and the mounting plate are rigid and fixed in the manner described above, as pressure is increased in the bladder the bladder forces the retaining ring to travel downwardly, away from the mounting plate. Thus, the bottom surface of the retaining ring may be maintained at a predetermined or desired level relative to the front side of the wafer even as the bottom surface of the retaining ring is worn away. The inflatable bladder also ensures that the down force or pressure at the bottom surface of the retaining ring is evenly distributed.

FIG. 4 shows a blown-up cross section of the retaining ring 30. The mounting plate 38, insert 31 and wafer 3 are separated from the retaining ring to more clearly show the retaining ring and inflatable bladder 36. FIG. 4 shows a ridge 73 having a rounded or hemispherical cross section. The ridge may be differently sized and shaped, so long as the inflatable bladder is pre-deformed to very closely conform to the size and shape of the groove in the retaining ring.

The shape of the ridge affects how the retaining ring puts pressure onto the polishing pad, thus the shape of a ridge or ridges disposed in the retaining ring may be adjusted to change the performance of a retaining ring. The placement of the ridge within the retaining ring also changes the performance of the retaining ring. For example, a lopsided ridge, such as a right triangle, or a ridge asymmetrically disposed relative to the walls of the bladder will cause the retaining ring to lean with respect to the axis of the wafer carrier. In other words, the retaining ring will place more pressure towards either the leading edge or the trailing edge of the bottom surface of the retaining ring.

In addition, the ridge shown in FIG. 4 may be disposed on a second ring 74 that is mounted to the floor of the groove. The second ring has a hemispherical cross section, as shown in FIG. 4. Thus, the ridge need not be integrally formed with the retaining ring and the ridge may be provided as a separate ring mounted to the retaining ring. In addition to forming the ridge, the second ring also reinforces the retaining ring, especially if the second ring is made from a material that is stiffer than the material from which the retaining ring is made. The second ring also decreases the depth of the groove, which may further help the bladder to more closely conform to the shape of the groove and may affect how the bladder expands within the groove (depending on the shape of the bladder).

In other wafer carriers, a second ring (or even third ring) could be mounted to the groove to change the effective shape of the groove. Thus, the effective dimensions of the groove could be changed to conform to the size and dimensions of an available bladder. For example, a second ring having a concave, hemispherical cross section may be mounted to the floor of the groove so that an available cylindrical bladder will substantially conform to the size and dimensions of the groove. (A second ring having a convex hemispherical cross section would create the effect of a ridge, similar to that shown in FIG. 4.

The retaining ring shown in FIGS. 2 and 3 has a groove with an opening facing the mounting plate so that, in use, the bladder is pinched between the floor of the groove and the mounting plate. However, the groove may be provided with a flexible roof 75, in which case the groove may be referred to as a duct. The bladder is disposed in the duct. In use, the duct roof would deform with the bladder, causing the roof to press against the mounting plate and thereby causing the retaining ring to move along the axis of the wafer carrier.

Figure 5:
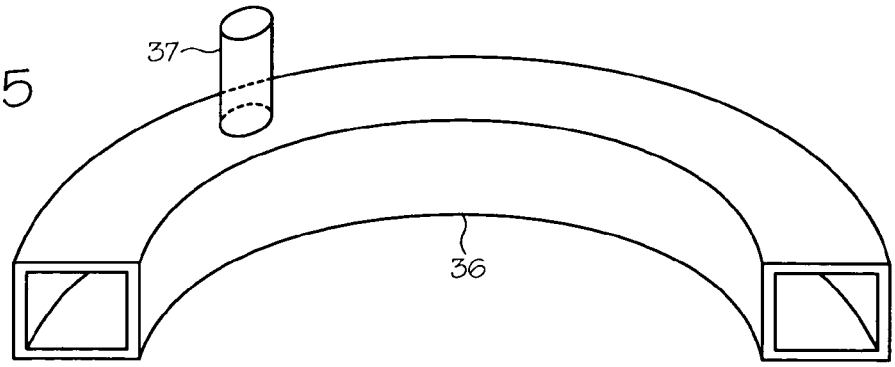
FIG. 5 shows a portion of the inflatable bladder.

FIG. 5 shows a radial cross section of the inflatable bladder 36 and shows the fluid supply tube 37 attached to the inflatable bladder. As described in reference to FIGS. 1 through 4, the inflatable bladder is a resilient tubular hoop having a rectangular cross section. The inflatable bladder may have other cross sections and sizes, so long as the inflatable bladder may be inflated to substantially conform to the size and dimensions of the groove in the retaining ring. In addition, the inflatable bladder may be shaped, sized and dimensioned so that the bladder preferentially expands in a particular direction when the bladder is not otherwise constrained. (Thus, for some applications, less pressure is needed to deform the bladder, meaning that the same pressure will force the retaining ring to slide more towards the polishing pad.) The fluid supply tube may extend from any particular portion of the inflatable bladder, as required for operably disposing the tube within the wafer carrier and connecting it to the fluid supply.

In one of our own wafer carrier models, the inflatable bladder is preferably made from ethylene propylene diene monomer (EPDM) rubber. The inflatable bladder may be made from other materials, such as other rubbers or silicone, for use in different wafer carriers. The bladder is built to withstand normal operating pressures, typically about 1 PSI to about 60 PSI, preferably about 30 PSI. These bladder pressures cause the retaining ring to impart a pressure onto the polishing pad in the range of about 0 PSI to about 12 PSI.

In the same carrier, the slots and screws are sized and dimensioned to allow the retaining ring to move at least 0.030 inches along the direction of axis 39. Preferably, the slots and screws are sized and dimensioned to allow the retaining ring to move 0.090 inches or more along the direction of axis 39. The ridge extends from about 0.005 to about 0.100 inches or more from the floor of the groove, depending on the size and shape of the bladder and the size and shape of the retaining ring. Preferably, the ridge extends about 0.030 inches from the floor of the groove and is about 0.090 inches wide at the base relative to the width of the groove. Preferably, the groove is about 0.283 inches wide and about 0.215 inches deep. The retaining ring itself is preferably about 0.985 inches wide along its bottom surface and about 0.415 inches high from the lip of the groove to the bottom surface of the retaining ring. (Width refers to a distance along a radial line of the carrier and depth or height refers to a distance along a line parallel to the axis of the carrier.)

As described in reference to the figures, the ridge deforms the bladder to very closely conform to the shape of the groove. To accomplish this, the ridge need not be disposed on the floor of the retaining ring. The ridge may depend downwardly into the groove from the mounting plate or extend radially into the groove from either of the two walls of the groove in the retaining ring. Moreover, the ridge need not be symmetrically located within the groove. In other wafer carriers, multiple ridges are provided and each extends into the groove. Multiple ridges asymmetrically disposed within the retaining ring may be provided, with each ridge extending into the groove from one or more surfaces. In any case, the ridge should cause the inflatable bladder to very closely conform to the size and dimensions of the groove before pressure is added to the bladder.

In other wafer carriers, the inflatable bladder need not be connected to a fluid supply and instead may be pressurized sufficiently to urge the retaining ring towards the polishing pad when inserted into the carrier. However, in this configuration the pressure the retaining ring applies to the polishing pad cannot be adjusted.

In addition, other mechanisms may be provided to allow the retaining ring to be slidably attached to the mounting plate or other parts of the wafer carrier. For example, one or more lugs 80 may be provided in the mounting plate. If provided, the lugs are slidably disposed within corresponding grooves 81 disposed in the retaining ring. (Lugs 80 and grooves 81 are shown in FIG. 2.) Stops disposed on the lugs limit the vertical travel of the retaining ring. The lugs also help transfer torque from the mounting plate to the retaining ring. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A retaining ring for use in a wafer carrier, said retaining comprising:

a ring of material characterized by an upper surface and a lower surface, said ring couplable to a wafer carrier;

a groove disposed in the upper surface of the ring, said groove characterized by a floor, an inner sidewall, and outer sidewall; and a ridge extending from the floor of the groove;

wherein said groove is sized and dimensioned to accommodate an inflatable bladder.

2. The retaining ring of claim 1 wherein the ridge is substantially triangular in shape.

3. The retaining ring of claim 1 wherein the ridge is substantially arcuate in shape.

4. A ring-shaped washer sized and dimensioned to be disposed within a groove; said groove disposed within a retaining ring couplable to a wafer carrier and characterized by a floor, an inner sidewall; said washer comprising:

a ring of resilient material;

a substantially flat planar lower surface; and an upper surface having a ridge extending therefrom;

wherein said washer is mountable to the floor of the groove of the retaining ring.

5. The washer of claim 4 wherein the ridge is substantially triangular in shape.

6. The washer of claim 4 wherein the ridge is substantially arcuate in shape.

* * * * *